US008286357B2

(12) United States Patent
Huang

(10) Patent No.: US 8,286,357 B2
(45) Date of Patent: Oct. 16, 2012

(54) LOCKING MECHANISM FOR A FOLDING KNIFE

(76) Inventor: Yi Huang, Vancouver (CA)

( * ) Notice: Subject to any disclaimer, the term of this patent is extended or adjusted under 35 U.S.C. 154(b) by 131 days.

(21) Appl. No.: 12/807,088

(22) Filed: Aug. 27, 2010

(65) Prior Publication Data

US 2011/0067247 A1 Mar. 24, 2011

Related U.S. Application Data

(60) Provisional application No. 61/243,961, filed on Sep. 18, 2009.

(51) Int. Cl.
*B26B 1/04* (2006.01)

(52) U.S. Cl. ..... 30/161; 30/160

(58) Field of Classification Search ..... 30/160, 30/161

See application file for complete search history.

(56) References Cited

U.S. PATENT DOCUMENTS

| | | | | |
|---|---|---|---|---|
| 4,811,486 | A * | 3/1989 | Cunningham | 30/161 |
| 5,095,624 | A * | 3/1992 | Ennis | 30/161 |
| 5,461,786 | A | 10/1995 | Miller | |
| 5,737,841 | A * | 4/1998 | McHenry et al. | 30/161 |
| 6,122,829 | A * | 9/2000 | McHenry et al. | 30/161 |
| 6,370,778 | B1 | 4/2002 | Conable | |
| 6,574,869 | B1 * | 6/2003 | McHenry et al. | 30/161 |
| 7,340,837 | B1 * | 3/2008 | Busse | 30/153 |
| 7,600,322 | B2 * | 10/2009 | Kao | 30/151 |
| 7,774,939 | B1 * | 8/2010 | Onion | 30/161 |
| 2009/0144986 | A1 * | 6/2009 | Frazer | 30/159 |
| 2010/0192381 | A1 * | 8/2010 | Sakai | 30/160 |
| 2012/0017443 | A1 * | 1/2012 | Hao | 30/161 |

* cited by examiner

*Primary Examiner* — Hwei C Payer

(74) *Attorney, Agent, or Firm* — Ted Masters

(57) ABSTRACT

A locking mechanism for a folding knife includes a thumb post which longitudinally moves along slots in the handle of the knife. The thumb post is urged by a spring loaded locking lever into a notch in the base of the blade of the knife. When so positioned the thumb post retains the blade in an extended position. When the user pushes the thumb post out of the notch, the blade can be folded into the handle of the knife. In another embodiment the thumb post is an integral part of the locking lever, and it is a tab on the locking lever rather than the thumb post engages the notch in the base of the blade.

2 Claims, 8 Drawing Sheets

7/8

LOCKING MECHANISM FOR A FOLDING KNIFE

CROSS REFERENCE TO RELATED APPLICATION

This application claims the filing benefit under 35 U.S.C. §119(e) of U.S. Provisional Application No. 61/243,961, filed Sep. 18, 2009, which is hereby incorporated by reference.

TECHNICAL FIELD

The present invention pertains generally to knives, and more particularly to a locking mechanism for a folding knife.

BACKGROUND OF THE INVENTION

A folding knife is a cutting tool in which the blade is connected to the handle through a pivot, allowing the blade to fold into the handle. To prevent injury to the user's hand caused by accidental closing, folding knives typically have a locking mechanism. Different locking mechanisms are favored by various individuals for reasons such as perceived strength (lock safety) and ease of use (ergonomics). Knife manufacturers will also consider costs to make the components, tolerances, durability and possible warranty claims.

Inventors have come up with various designs of locking mechanisms for folding knives Several of the latest inventions focus on improving the ergonomics of operation, especially on opening and closing the blade with one hand, by building a thumb stud into the forward portion of the handle. However most of these designs are complicated in structure, requiring a large number of parts, and use small unreliable omega springs. As a result, the knives are difficult to manufacture, and result in higher production cost compared to older and simpler designs.

BRIEF SUMMARY OF THE INVENTION

The present invention is directed to a locking mechanism for a folding knife. The knife has a spring assisted locking lever and ambidextrous thumb posts which projects through openings on the handle for unlocking the blade. The knife enables easy and safe one hand use (opening and closing the blade), and at the same time keeps the number of parts and manufacturing complication to a minimum. The knife is safer for the operator to use, because the mechanism is designed in a way that when unlocking the blade, the operator naturally has all of his fingers out of the way of the blade path. As a result, accidental snap-closing or cutting of fingers are unlikely to happen.

In accordance with a preferred embodiment, a folding knife includes a handle, the handle including (1) a first wall spaced apart from a second wall, (2) a central longitudinal axis, (3) a front end, and (4) an opposite rear end. The first wall has a first slot disposed near the front end of the handle, the first slot being completely surrounded by the first wall. The first slot has a first slot axis which is oriented substantially perpendicular to the central longitudinal axis of the handle. The second wall has a second slot disposed near the front end of the handle, the second slot being completely surrounded by the second wall. The second slot has a second slot axis which is oriented substantially perpendicular to the central longitudinal axis of the handle. A blade has a tip and an opposite base, the base is pivotally connected to said first and second walls of said handle so that said blade can be placed in (1) an extended position, and (2) a fully folded position between the first and second walls of the handle. The base of the blade has a notch. A locking lever is disposed between the first and second walls, the locking lever including a front end, a middle section, and a rear end, the middle section is pivotally connected to the first and second walls. A spring is disposed between the first and second walls near the rear end of the handle, the spring contacting the rear end of the locking lever and urging the front end of the locking lever toward the central longitudinal axis of the handle. A thumb post is slidably disposed within the first and second slots, the thumb post extending completely through the handle, and the thumb post longitudinally movable along the first and second slots.

In accordance with another embodiment, the thumb post resides in abutting relationship with the front end of the locking lever, wherein the spring causes the thumb post to be urged toward the central longitudinal axis of the handle. The thumb post is received by the notch in the base of the blade when the blade is in the extended position, and the thumb post retains the blade in the extended position.

In accordance with another embodiment, the thumb post is not connected to the locking lever.

In accordance with another embodiment, the spring is the only spring included in the folding knife.

In accordance with another embodiment, the locking lever has a front end which has a hole and a tab. The thumb post is received by the hole in the locking lever and projects outward in opposite directions therefrom. The tab is received by the notch in the base of the blade when the blade is in the extended position, the tab retaining the blade in the extended position.

Other possible embodiments, in addition to the possible embodiments enumerated above, will become apparent from the following detailed description, taken in conjunction with the accompanying drawings, which illustrate, by way of example, the principles of the locking mechanism for a folding knife.

DETAILED DESCRIPTION OF THE INVENTION

Figure 1:
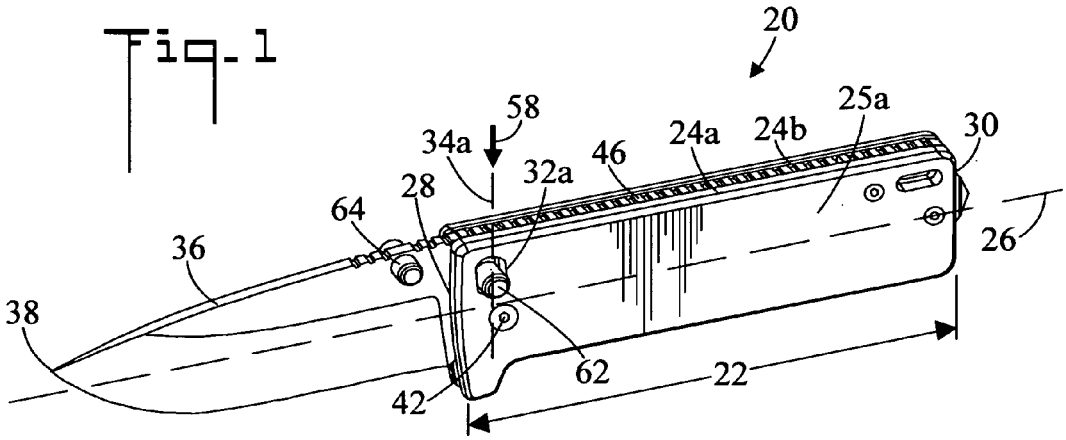
FIG. 1 is a perspective view of a folding knife.
Figure 2:
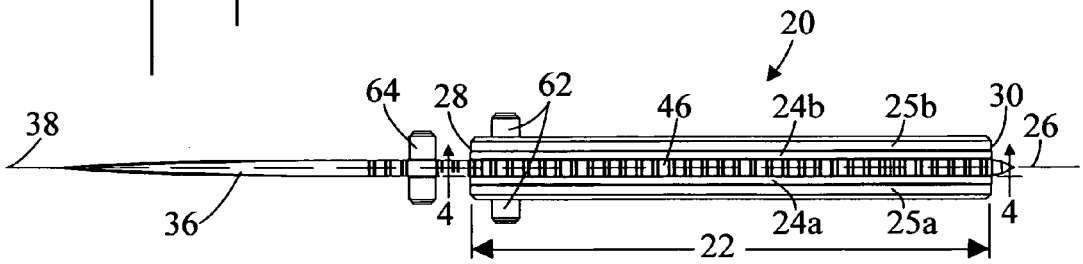
FIG. 2 is a top plan view of the folding knife.
Figure 3:
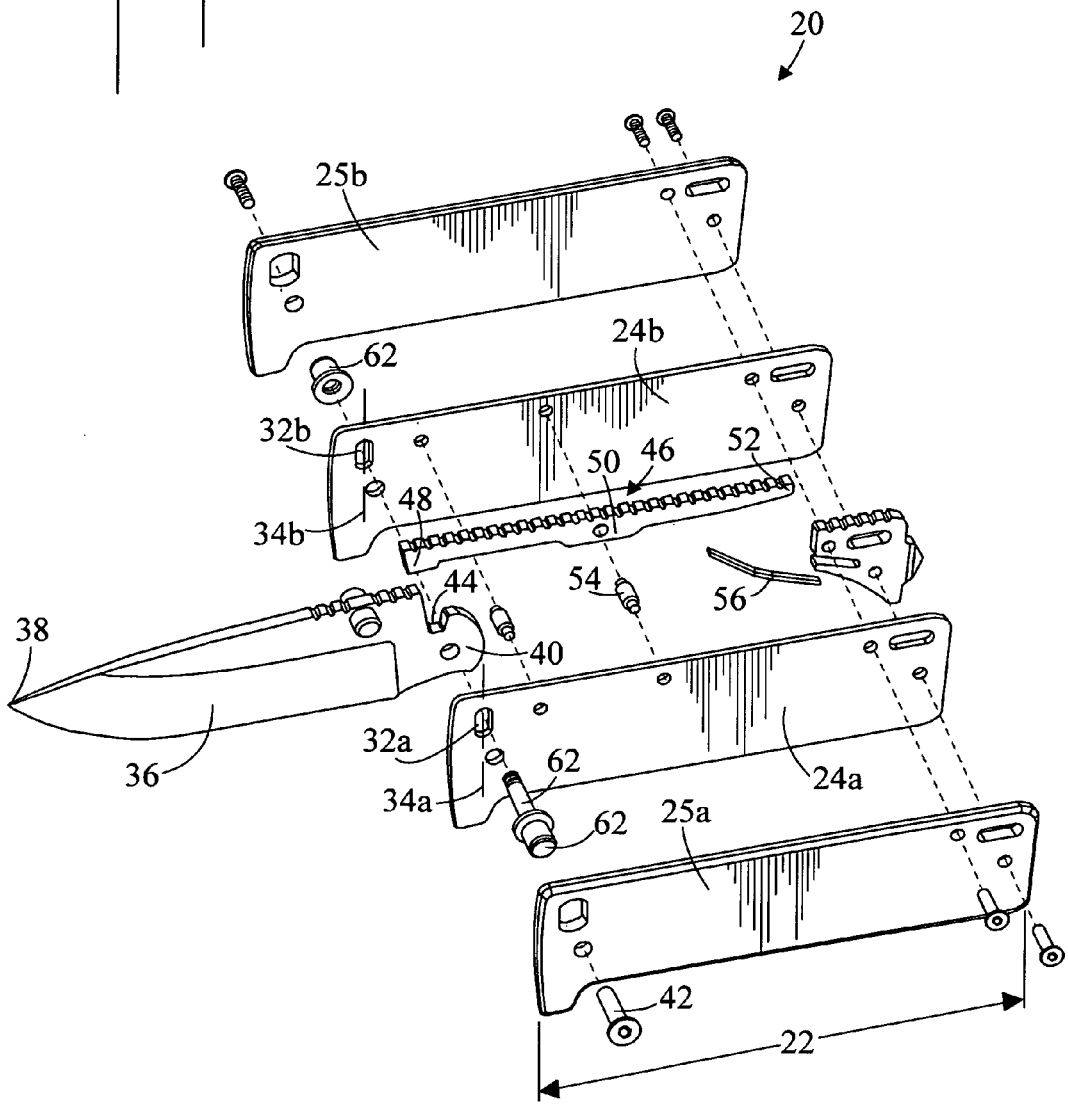
FIG. 3 is an exploded perspective view of the folding knife.
Figure 4:
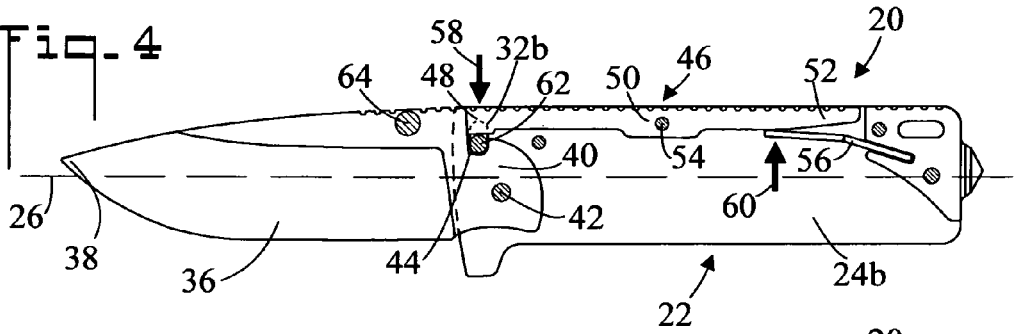
FIG. 4 is a cross sectional view along the line 4-4 of FIG. 2 showing the folding knife with the blade in an extended position.

Referring initially to FIGS. 1-3, there are illustrated perspective, top plan, and exploded perspective views respectively of a folding knife generally designated as 20. FIG. 4 is a cross sectional view along the line 4-4 of FIG. 2 with the blade of the knife in an extended position. Folding knife 20 includes a handle 22 which has (1) a first wall 24*a* spaced apart from a second wall 24*b*, (2) a central longitudinal axis 26, (3) a front end 28, and (4) an opposite rear end 30. First wall 24*a* has a first slot 32*a* disposed near front end 28 of handle 22, first slot 32*a* being disposed within and completely surrounded by first wall 24*a*. First slot 32*a* has a first slot axis 34*a* which runs along the length of the slot, and which is oriented substantially perpendicular to central longitudinal axis 26 of handle 22 (refer to FIG. 1). Second wall 24*b* has a second slot 32*b* disposed near front end 28 of handle 22, second slot 32*b* being disposed within and completely surrounded by second wall 24*b*. Second slot 32*b* has a second slot axis 34*b* which runs along the length of the slot, and which is oriented substantially perpendicular to central longitudinal axis 26 of handle 22 (refer to FIG. 8). Handle 22 further includes optional first 25*a* and second 25*b* decorative grip panels which connect to first 24*a* and second 24*b* walls respectively. It is noted that in FIG. 4, (and also in FIGS. 5-6 and 8-10) the cross sectional view is toward the second wall 24*b*, and as such first wall 24*a* and grip panel 25*a* are not seen.

Folding knife 20 further includes a blade 36 having a tip 38 and an opposite base 40. Base 40 is pivotally connected to first 24*a* and second 24*b* walls of handle 22 by a pivot 42, so that blade 36 can be placed in (1) an extended position as shown in FIGS. 1 and 2, and (2) a fully folded position between first 24*a* and second 24*b* walls of handle 22 (refer also to FIG. 7). That is, blade 36 can be extended or folded into handle 22 between first wall 24*a* and second wall 24*b* in a manner well known in the knife art. Base 40 of blade 36 has a notch 44 (refer also to FIG. 5).

Folding knife 20 further includes a locking lever 46 which is disposed between first 24*a* and second 24*b* walls, locking lever 46 including a front end 48, a middle section 50, and a rear end 52. Middle section 50 is pivotally connected to first 24*a* and second 24*b* walls by a pivot 54.

A spring 56 is disposed between and connected to first 24*a* and second 24*b* walls near rear end 30 of handle 22, spring 56 contacting rear end 52 of locking lever 46 and urging front end 48 of locking lever 46 toward central longitudinal axis 26 of handle 22 in direction 58. That is, spring 56 pushes up on the rear end 52 in direction 60, thereby causing locking lever 46 to pivot about pivot 54 and force front end 48 of locking lever 46 toward central axis 26 in direction 58. It is noted that spring 56 is the only spring included in folding knife 20.

Figure 8:
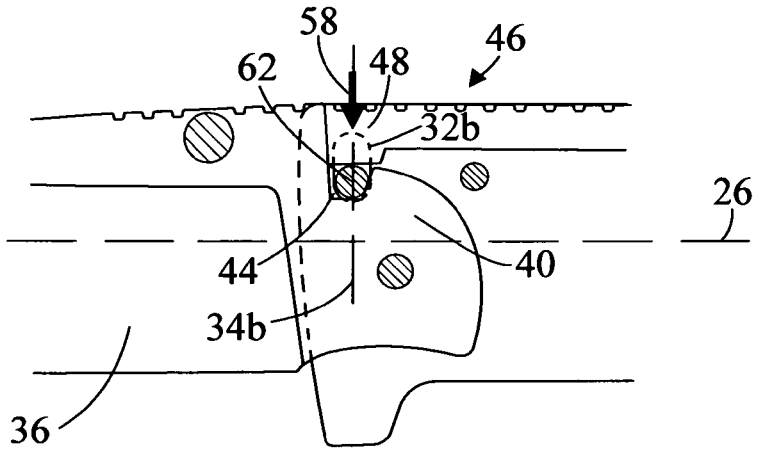
FIG. 8 is an enlarged fragmented cross sectional view showing the blade in the extended position.
Figure 9:
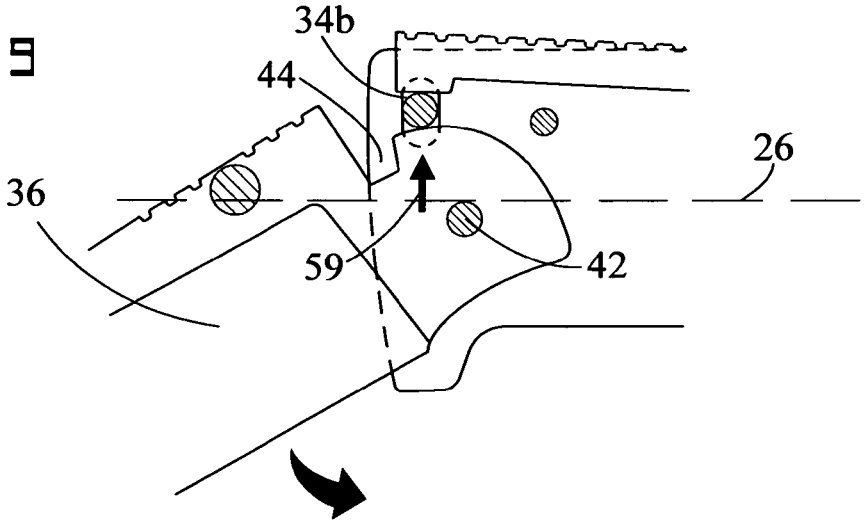
FIG. 9 is an enlarged fragmented cross sectional view showing the blade partially folded.

Folding knife 20 further includes a thumb post 62 which is slidably disposed within first 32*a* and second 32*b* slots, thumb post 62 extending completely through handle 22 as is shown in FIG. 2, and can be moved by either the right thumb (right handed users) or the left thumb (left handed users). Thumb post 62 is longitudinally movable along first 32*a* and second 32*b* slots. Longitudinally movable means that thumb post 62 is movable form one position in slots 32*a* and 32*b* to a another longitudinally different position without tilting or rotating. For example, FIG. 8 shows thumb post 62 in one longitudinal position, and FIG. 9 shows thumb post 62 moved up to a second longitudinal position.

Through the biasing action of spring 56, thumb post 62 resides in abutting relationship with front end 48 of locking lever 46, wherein spring 56 causes thumb post 62 to be urged toward central longitudinal axis 26 of handle 22. Referring to FIG. 4, thumb post 62 is received by notch 44 in base 40 of blade 36 when blade 36 is in the extended position. In this position, thumb post 62 is received by notch 44 and retains blade 36 in the extended position. As can be seen in FIGS. 4-7, through the action of spring 56, thumb post 62 is continuously abuttingly disposed between base 40 of blade 36 and front end 48 of locking lever 46. It is further noted that thumb post 62 is not connected to locking lever 46. Not connected means that thumb post 62 is a completely separate element from locking lever 46, and is not attached in any way to locking lever 46, such as passing though a hole in locking lever 46, being an integral part of locking lever 46, being welded or press fit to locking lever 46, etc.

Figure 11:
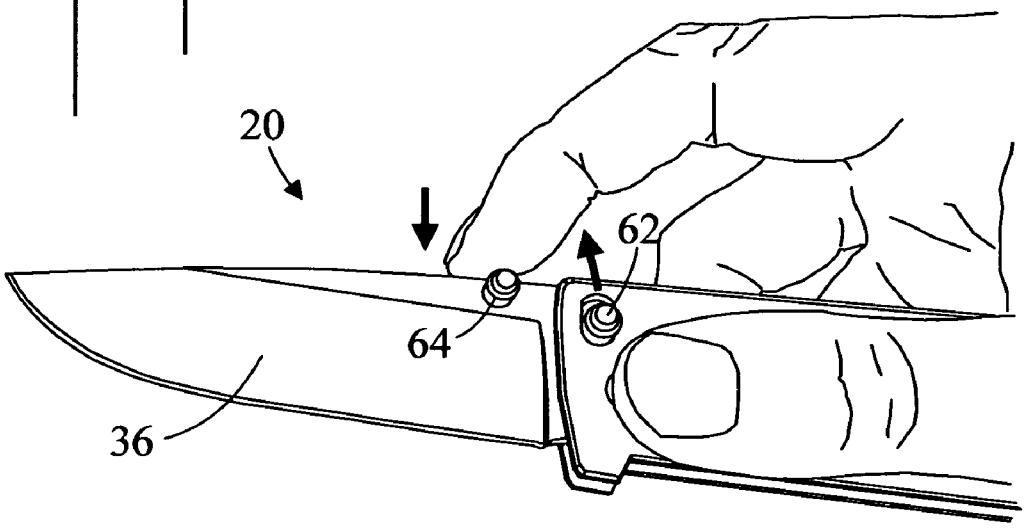
FIG. 11 is a perspective view of a user preparing to fold the blade.
Figure 12:
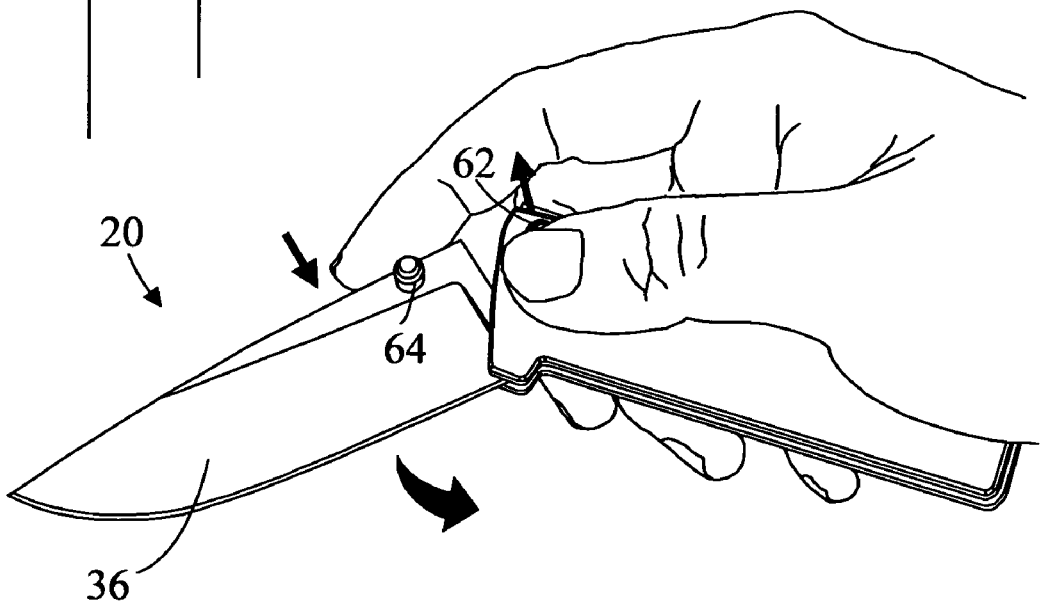
FIG. 12 is a perspective view of the user folding the blade.

A blade opening stud 64 is used to move blade 36 to a folded position (refer to FIGS. 11 and 12 and the associated discussion).

Figure 5:
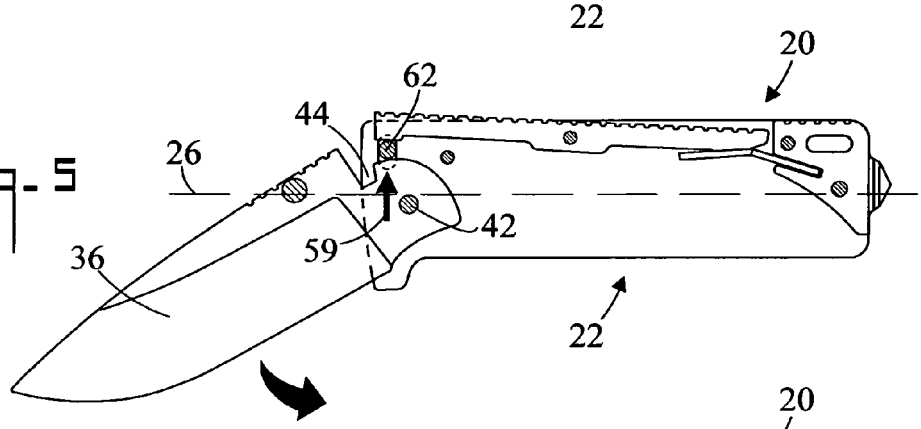
FIG. 5 is a cross sectional view as in FIG. 4 showing the folding knife with the blade partially folded.
Figure 6:
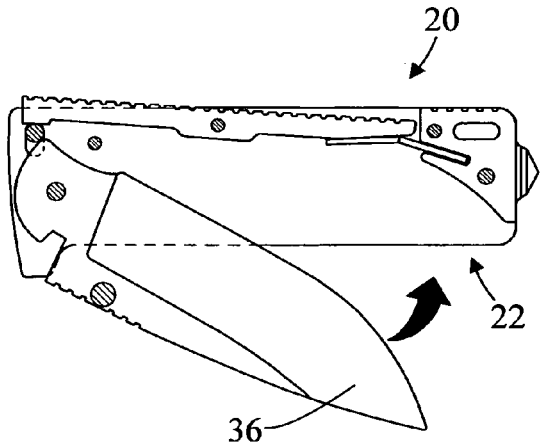
FIG. 6 is a cross sectional view as in FIG. 4 showing the folding knife with the blade further folded.
Figure 7:
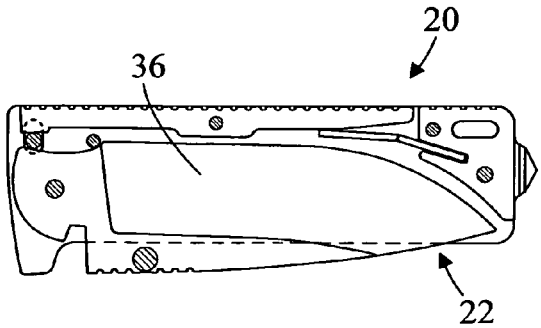
FIG. 7 is a cross sectional view as in FIG. 4 showing the folding knife with the blade in a fully folded position.

FIG. 4 through 7 are cross sectional views showing the various folding states of folding knife 20. In FIG. 4 blade 36 is in the extended position. Thumb post 62 is forced in direction 58 by the action of spring 56 into notch 44 of base 40 of blade 36 thereby preventing blade 36 from rotating about pivot 42. In FIG. 5 the user has pushed thumb post 62 away from central longitudinal axis 26 in direction 59 and out of notch 44, thereby allowing blade 36 to be rotated about pivot 42 toward handle 22. In FIG. 6 the folding action of blade 36 continues toward handle 22. In FIG. 7 blade 36 is in the fully folded position wherein blade 36 resides in handle 22. It is noted that during the folding sequence of FIGS. 4-7, thumb post 62 is continuously in contact with front end 48 of locking lever 46 and base 40 of blade 36.

Figure 10:
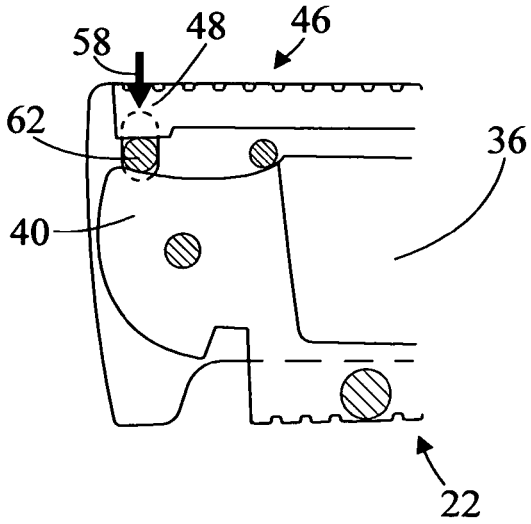
FIG. 10 is an enlarged fragmented cross sectional view showing the blade in the fully folded position.

FIGS. 8 through 10 are enlarged fragmented cross sectional views of FIGS. 4, 5, and 7 respectively showing of blade 36 in the extended position, partially folded, and fully folded position respectively. In FIG. 8 front end 48 of locking lever 46 urges thumb post 62 in direction 58 into notch 44 in base 40 of blade 36 thereby holding blade 36 in the extended position. It is noted that thumb post 62 longitudinally moves along first 32*a* and second 32*b* slots along slot axes 34*a* and 34*b* which are perpendicular to central longitudinal axis 26. In FIG. 9 the user has longitudinally moved thumb post 62 in direction 59 away from central longitudinal axis 26 along first 32*a* (not shown) and second 32*b* slots so that thumb post 62 no longer resides in notch 44. Blade 36 then can be rotated about pivot 42 toward the fully folded position. In FIG. 10 blade 36 is in the fully folded position inside handle 22. Front end 48 of locking lever 46 urges thumb post 62 into engagement with base 40 of blade 36 to retain blade 36 in the fully folded position.

FIG. 11 is a perspective view of a user preparing to fold blade 36. The user holds handle 22 and positions his/her thumb on thumb post 62 and his/her index finger on blase opening stud 64. Then as shown in FIG. 12, the user simultaneously exerts and upward force on thumb post 62 and a downward force on blade opening stud 64. Referring also to FIGS. 4-5, the upward force moves thumb post 62 out of notch 44 thereby allowing blade 36 to be folded by the user's index finger.

Figure 13:
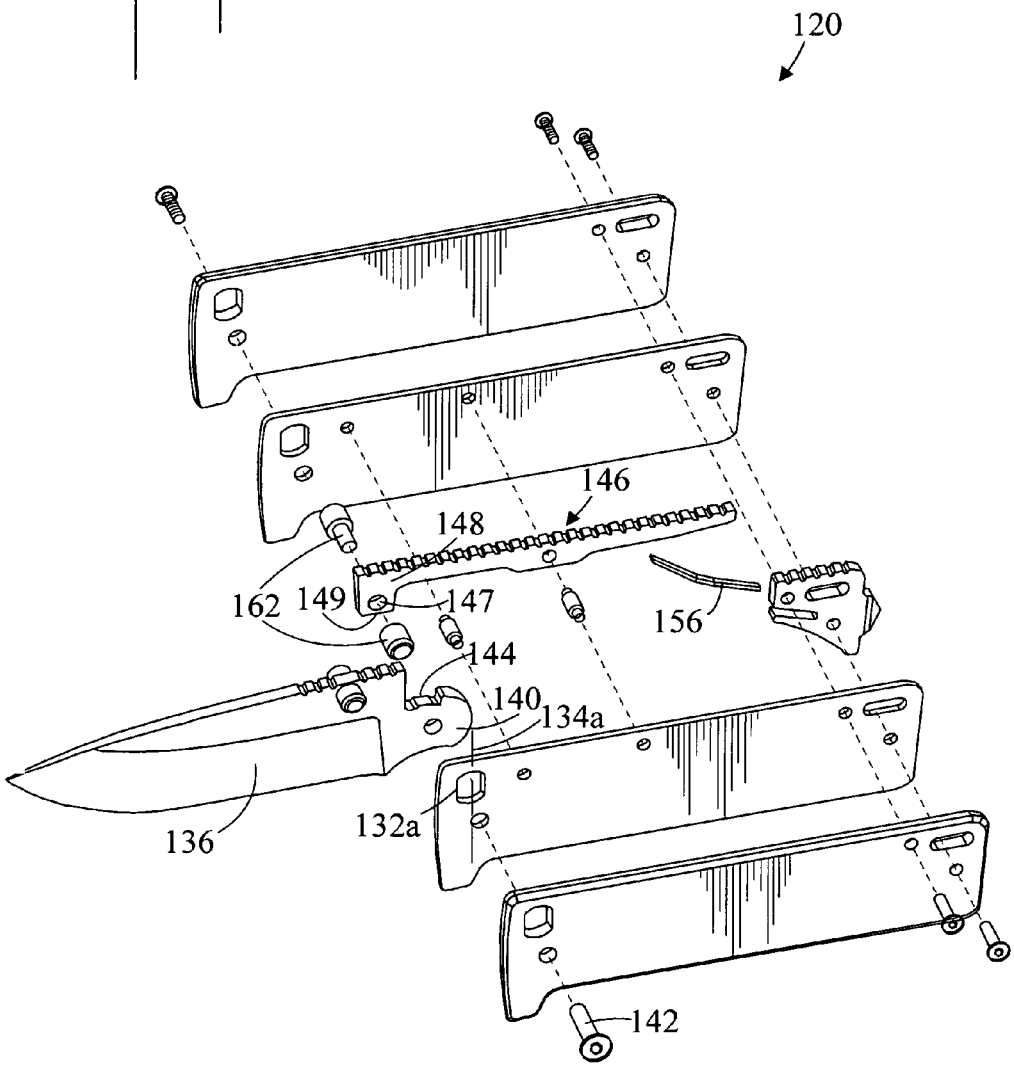
FIG. 13 is an exploded perspective view of a second embodiment of the folding knife.
Figure 14:
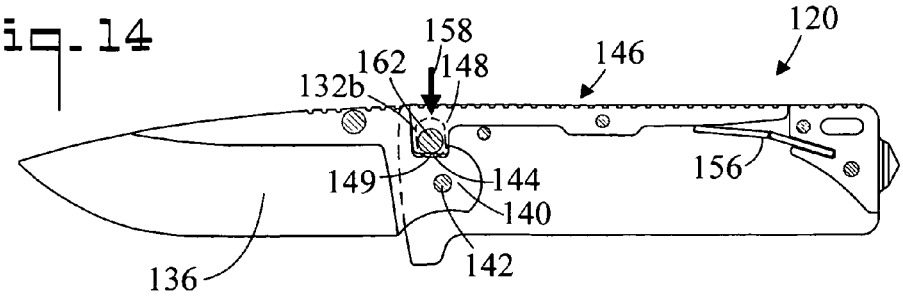
FIG. 14 is a cross sectional view as in FIG. 4 showing the second embodiment folding knife with the blade in an extended position.

FIGS. 13 and 14 are exploded perspective and cross sectional views respectively of a second embodiment of the folding knife generally designated as 120. Folding knife 120 is similar to folding knife 20 with an exception of locking lever 146 and thumb post 162. In contrast to the separate thumb post 62 of embodiment 20, in embodiment 120 thumb post 162 is connected to and is an integral part of locking lever 146. Thumb post 162 longitudinally moves in first 132*a* and second 132*b* slots along slot axes 134*a* and 134*b* which are perpendicular to central longitudinal axis 126 (refer to FIGS. 13 and 18). Locking lever 146 has a front end 148 having a hole 147 and tab 149. Thumb post 162 is received by hole 147 in locking lever 146 and projects outward in opposite directions therefrom. Tab 149 is received by notch 144 in base 140 of blade 136 when blade 136 is in the extended position, and tab 149 retains blade 136 in the extended position. This is in contrast to embodiment 20 in which it is thumb post 62 which engages notch 44.

Figure 15:
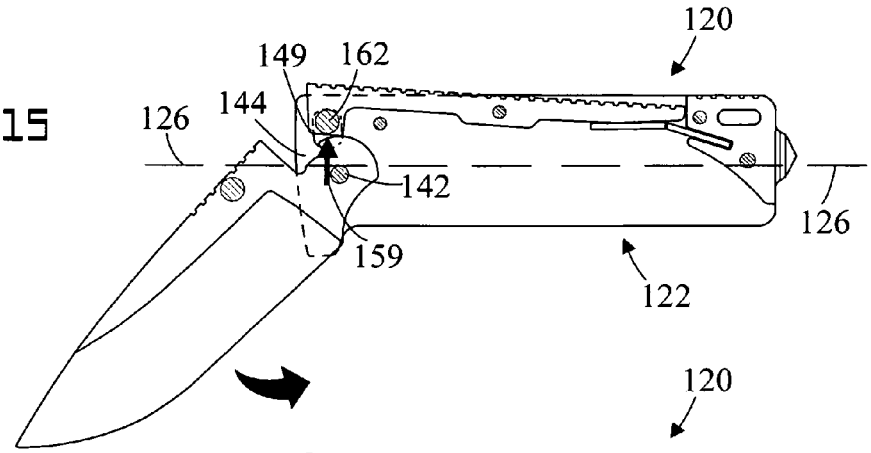
FIG. 15 is a cross sectional view as in FIG. 14 showing the second embodiment folding knife with blade partially folded.
Figure 16:
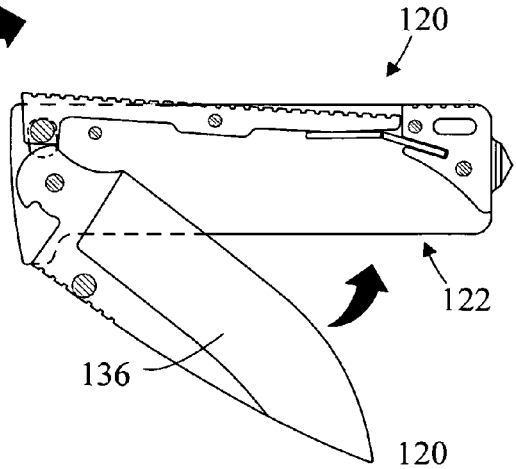
FIG. 16 is a cross sectional view as in FIG. 14 showing the second embodiment folding knife with the blade further folded.
Figure 17:
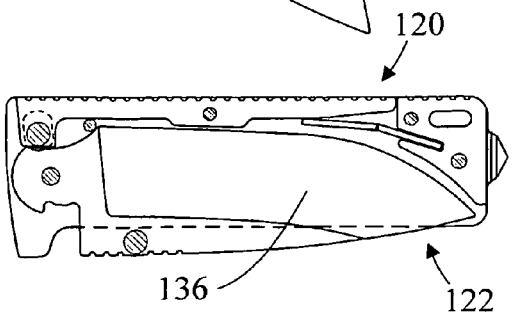
FIG. 17 is a cross sectional view as in FIG. 14 showing the second embodiment folding knife with the blade in a fully folded.

FIG. 14 through 17 are cross sectional views similar to the FIGS. 4-7 showing the various folding states of folding knife 120. In FIG. 14 blade 136 is in the extended position. Tab 149 is forced in direction 158 by the action of spring 156 into notch 144 of base 140 of blade 136 thereby preventing blade 136 from rotating about pivot 142. In FIG. 15 the user has pushed thumb post 162 in direction 159 away from central longitudinal axis 126 moving tab 149 out of notch 144, thereby allowing blade 136 to be rotated about pivot 142 toward handle 122. In FIG. 16 the folding action of blade 136 continues toward handle 122. In FIG. 17 blade 136 is in the fully folded position wherein blade 136 resides in handle 122. It is noted that during the folding sequence of FIGS. 14-17, tab 149 is continuously in contact with base 140 of blade 136.

Figure 18:
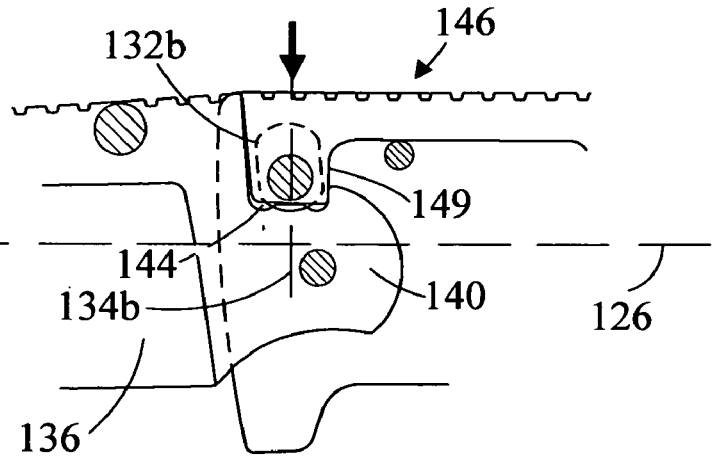
FIG. 18 is an enlarged fragmented cross sectional view showing the second embodiment folding knife with the blade in the extended position.
Figure 19:
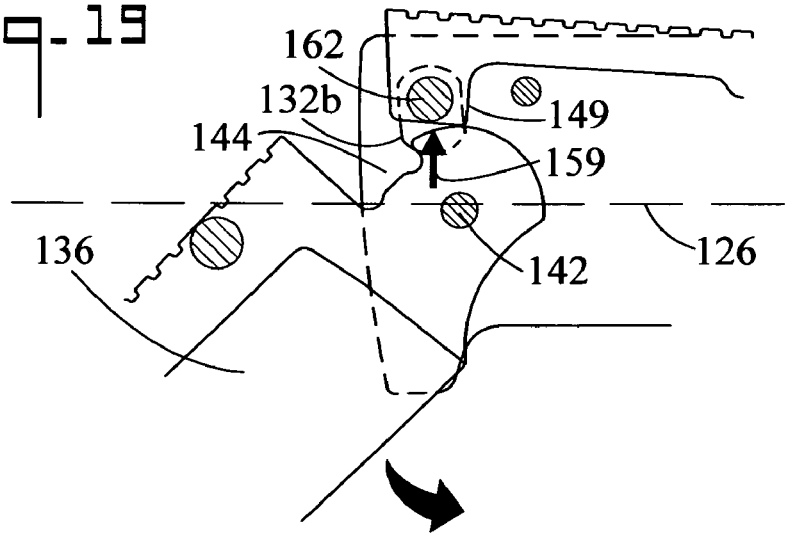
FIG. 19 is an enlarged fragmented cross sectional view showing the second embodiment folding knife with the blade partially folded; and, FIG. 20 is an enlarged fragmented cross sectional view showing the second embodiment folding knife with the blade fully folded.
Figure 20:
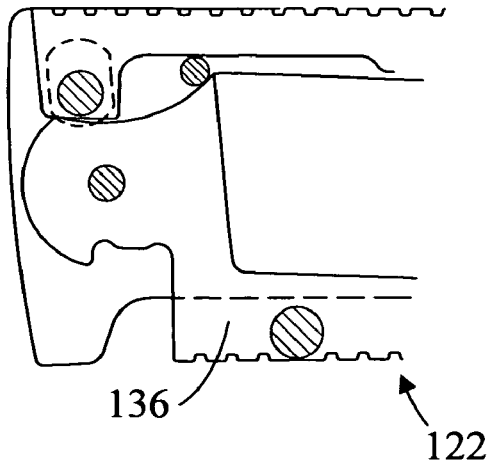

FIGS. 18 through 20 are enlarged fragmented cross sectional views of FIGS. 14, 16, and 17 respectively showing blade 136 in the extended position, partially folded, and fully folded position respectively. In FIG. 18 tab 149 of locking lever 146 is urged into notch 144 in base 140 of blade 136 thereby holding blade 136 in the extended position. In FIG. 19 the user has longitudinally moved thumb post 162 in direction 159 away from central longitudinal axis 126 along first 132*a* (refer to FIG. 13) and second 132*b* slots so that tab 149 no longer resides in notch 144. Blade 136 then can be rotated about pivot 142 toward the fully folded position. In FIG. 20 blade 136 is in the fully folded position inside handle 122.

The possible embodiments of the locking mechanism for a folding knife described herein are exemplary and numerous modifications, combinations, variations, and rearrangements can be readily envisioned to achieve an equivalent result, all of which are intended to be embraced within the scope of the appended claims. Further, nothing in the above-provided discussions of the locking mechanism for a folding knife should be construed as limiting the invention to a particular embodiment or combination of embodiments. The scope of the invention is best defined by the appended claims.

I claim:

1. A folding knife comprising:

a handle, said handle including a first wall spaced apart from a second wall, a central longitudinal axis, a front end, and an opposite rear end;

said first wall having a first slot disposed near said front end of said handle, said first slot being completely surrounded by said first wall;

said first slot having a first slot axis which is oriented substantially perpendicular to said central longitudinal axis of said handle;

said second wall having a second slot disposed near said front end of said handle, said second slot being completely surrounded by said second wall, said second slot having a second slot axis which is oriented substantially perpendicular to said central longitudinal axis of said handle;

a blade having a tip and an opposite base, said base pivotally connected to said first and second walls of said handle so that said blade can be placed in an extended position, and a fully folded position between said first and second walls;

said base of said blade having a notch;

a locking lever disposed between said first and second walls, said locking lever including a front end, a middle section, and a rear end, said middle section pivotally connected to said first and second walls;

a spring disposed between said first and second walls, said spring contacting said rear end of said locking lever and urging said front end of said locking lever toward said central longitudinal axis of said handle;

a thumb post slidably disposed within said first and second slots, said thumb post extending completely through said handle, and said thumb post longitudinally movable along said first and second slots;

said front end of said locking lever having a hole and a tab;

said thumb post received by said hole in said locking lever and projecting outward in opposite directions therefrom; and said tab received by said notch in said base of said blade when said blade is in said extended position, said tab retaining said blade in said extended position.

2. A folding knife comprising:

a handle, said handle including a first wall spaced apart from a second wall, a central longitudinal axis, a front end, and an opposite rear end;

said first wall having a first slot disposed near said front end of said handle, said first slot being completely surrounded by said first wall;

said first slot having a first slot axis which is oriented substantially perpendicular to said central longitudinal axis of said handle;

said second wall having a second slot disposed near said front end of said handle, said second slot being completely surrounded by said second wall, said second slot having a second slot axis which is oriented substantially perpendicular to said central longitudinal axis of said handle;

a blade having a tip and an opposite base, said base pivotally connected to said first and second walls of said handle so that said blade can be placed in an extended position, and a fully folded position between said first and second walls;

said base of said blade having a notch;

a locking lever disposed between said first and second walls, said locking lever including a front end, a middle section, and a rear end, said middle section pivotally connected to said first and second walls;

a spring disposed between said first and second walls, said spring contacting said rear end of said locking lever and urging said front end of said locking lever toward said central longitudinal axis of said handle;

a thumb post slidably disposed within said first and second slots, said thumb post extending completely through said handle, and said thumb post longitudinally movable along said first and second slots;

said front end of said locking lever having a tab;

said thumb post connected to said locking lever and projecting outward in opposite directions therefrom; and said tab received by said notch in said base of said blade when said blade is in said extended position, said tab retaining said blade in said extended position.

* * * * *